US006042454A

United States Patent [19]

Watanabe et al.

[11] Patent Number: 6,042,454

[45] Date of Patent: Mar. 28, 2000

[54] SYSTEM FOR DETECTING THE ENDPOINT OF THE POLISHING OF A SEMICONDUCTOR WAFER BY A SEMICONDUCTOR WAFER POLISHER

[75] Inventors: Katsuhide Watanabe; Akira Ogata, both of Kanagawa-ken; Fumihiko Sakata, Yokohama, all of Japan

[73] Assignee: Ebara Corporation, Tokyo, Japan

[21] Appl. No.: 09/090,265

[22] Filed: Jun. 4, 1998

[30] Foreign Application Priority Data

Jun. 4, 1997 [JP] Japan ..... 9-161921

[51] Int. Cl.[7] ..... B24B 49/00

[52] U.S. Cl. ..... 451/6; 451/5; 451/41; 451/288

[58] Field of Search ..... 451/5, 41, 6, 285–290

[56] References Cited

U.S. PATENT DOCUMENTS

| | | | |
|---|---|---|---|
| 5,667,424 | 9/1997 | Pan | 451/5 |
| 5,672,091 | 9/1997 | Takahashi et al. | 451/6 |
| 5,762,536 | 6/1998 | Pant et al. | 451/6 |
| 5,838,447 | 11/1998 | Hiyama et al. | 451/6 |
| 5,872,633 | 2/1999 | Holzapfel et al. | 451/6 |

FOREIGN PATENT DOCUMENTS

| | | |
|---|---|---|
| 06320416 | 11/1994 | Japan . |
| 6-320416 | 11/1994 | Japan . |
| 06342778 | 12/1994 | Japan . |
| 6-342778 | 12/1994 | Japan . |

*Primary Examiner*—Robert A. Rose
*Assistant Examiner*—G. Nguyen
*Attorney, Agent, or Firm*—Wenderoth, Lind & Ponack, L.L.P.

[57] ABSTRACT

A polisher provided with a vibration detection system which can detect vibration caused by rubbing between an article to be polished and a polishing member without any noise which is generated in prior art polishers. The polisher includes a turntable assembly with a polishing surface, a rotatable carrier assembly for holding an article to be polished in such a manner that the article is kept in contact, under pressure with the polishing member while being polished. A vibration detector is provided on the rotatable carrier assembly in order to detect the vibration caused by the rubbing between the article and the polishing member of the turntable assembly. A light signal emission device is provided on the rotatable carrier assembly and is adapted to receive electrical signals transmitted from the vibration detector to generate and emit light signals in response to the vibration detected by the detector. A light signal receiving device is provided on a stationary part of the polisher. The light emission device may be an infrared light emission device.

7 Claims, 4 Drawing Sheets

SYSTEM FOR DETECTING THE ENDPOINT OF THE POLISHING OF A SEMICONDUCTOR WAFER BY A SEMICONDUCTOR WAFER POLISHER

FIELD OF THE INVENTION

The present invention relates to a polisher for performing mirror surface polishing of a semiconductor wafer, and more specifically to a system for detecting an endpoint of a polishing conducted by such a polisher.

BACKGROUND OF THE INVENTION

Due to higher and higher degrees of integration of semiconductor circuits and the application of photolithography technology to form such semiconductor circuits, it is necessary to ensure a high degree of evenness or flatness of the surface of the semiconductor wafer onto which the circuits are to be applied. To even or flatten a surface of a semiconductor wafer, typically, a polisher is employed which includes a plurality of rotatable wafer carriers and a turntable with a polishing member such as a polishing pad, a grinding stone or a whet stone. Each of the rotatable carriers supports a wafer in such a manner that the wafer is kept in contact with the polishing surface of the turntable. The turntable is being rotated around a center axis passing through the center of and normal to the polishing surface of the turntable while abrasive slurry is supplied between the polishing surface and the surface of the wafer to be polished.

In such a polisher, an endpoint of the polishing is usually determined by timing the polishing operation on the basis of a polishing rate. The polishing rate is usually determined by conducting a test polishing in advance of an actual polishing. However, since the polishing rate can vary depending on changes in the polishing conditions, such as, the polishing surface, the pressure between a wafer and the polishing surface and so on, it is difficult to precisely determine the endpoint of the polishing only on the basis of trial timing. Another method for determining the endpoint of a polishing operation involves detecting a change in the torque of a motor rotating the turntable or wafer carrier by measuring an electric current supplied to the motor rotating the turntable or wafer carrier. A change in torque being effected when a certain amount of a dielectric material layer is removed, exposing the top surfaces of the semiconductor circuits which underlay the dielectric material layer. However, the resulting change in rotational torque is small and thus, it is difficult to accurately detect a change in electric current.

Another method for determining the endpoint of a polishing operation involves detecting a change in a vibration of a rotating wafer or wafer carrier which also occurs when the top surfaces of the semiconductor circuits are exposed. However, since the vibration is conventionally detected by an electrical vibration detector mounted on the rotational wafer carrier assembly and the electrical signal generated by the detector is received by a controller provided on a stationary part of the polisher, an electrical connector consisting of a stationary contact element and a rotational contact element rotationally engaged with the stationary element, are required to be provided between the stationary part and the rotational wafer carrier assembly. However, the noise generated in such a connector influences the vibration detection system. Further, such an electrical connector requires periodic maintenance. A similar connector is also needed to supply electric power to the vibration detection system.

SUMMARY OF THE INVENTION

It is therefore an object of the present invention to provide a polisher with a system that enables precise detection of the endpoint of the polishing without the need for the maintenance as mentioned above.

In accordance with the present invention, a polisher includes a turntable assembly including a turntable with a polishing member such as a polishing cloth or a grindstone, a rotatable carrier assembly for holding an article having a surface to be polished such that the surface of the article is kept in contact with the polishing member under pressure while being polished. A vibration detector is provided on one of the turntable assembly and the rotatable carrier assembly in order to detect vibration caused by the rubbing between the article and the polishing member of the turntable assembly. Further, a light emission device is provided on one of the turntable assembly and rotatable carrier assembly and is adapted to receive electrical signals transmitted from the vibration detector and to generate and emit light signals in response to the vibration detected by the vibration detector. A light signal receiving device is provided on a stationary element of the polisher. The light emission device may be an infrared light emission device.

The above features and advantages of the present invention will become apparent from the following description and the appended claims taken in conjunction with the accompanying drawings.

DETAILED DESCRIPTION OF PREFERRED EMBODIMENTS

Figure 1:
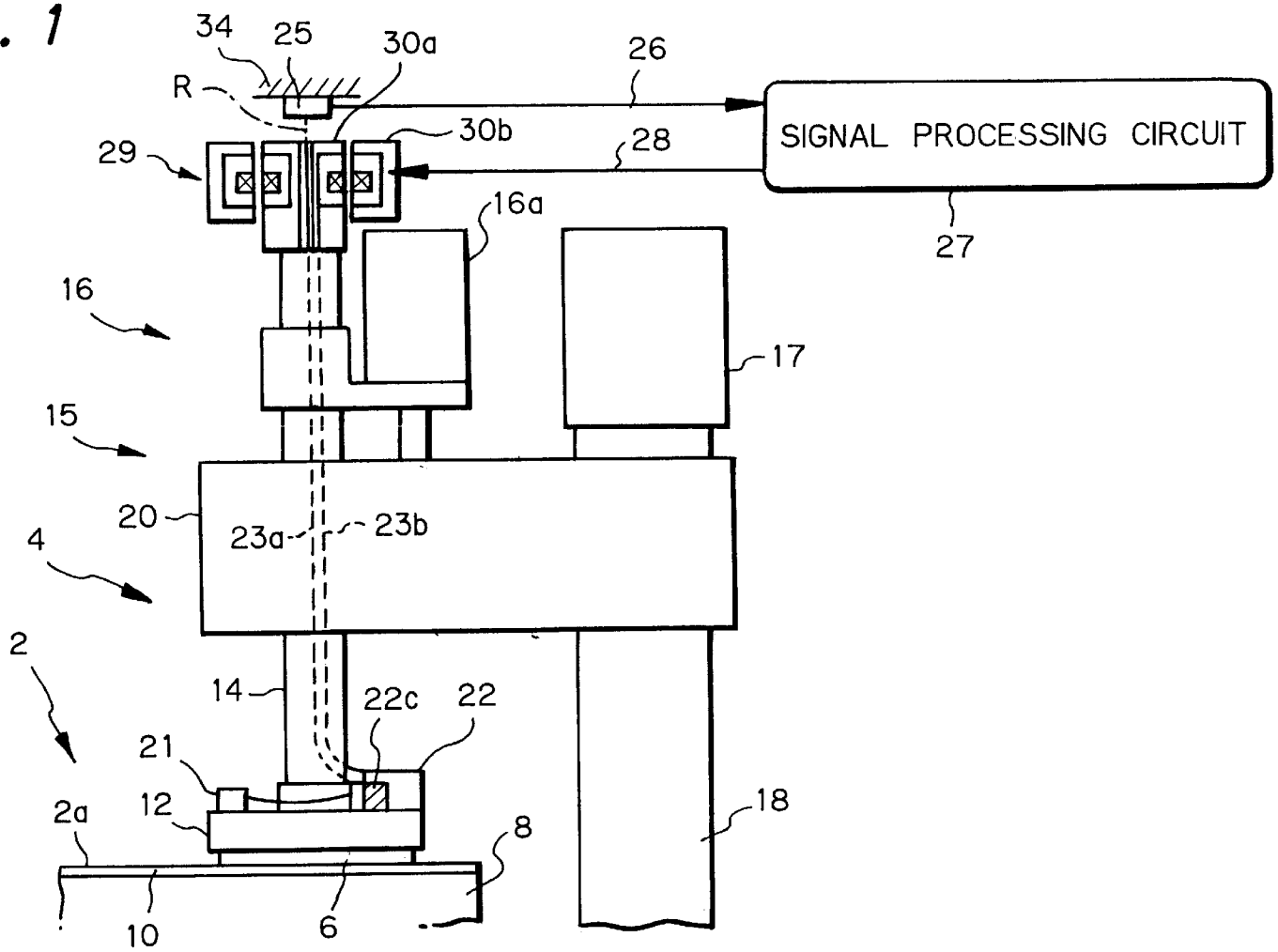
FIG. 1 is a schematic side elevation view of the main part of a semiconductor wafer polisher in accordance with a first embodiment of the present invention.

Referring to FIG. 1, the semiconductor wafer polisher includes a turntable assembly 2 defining a polishing surface 2*a* and a rotatable carrier assembly 4 for carrying a semiconductor wafer 6.

The turntable assembly 2 includes a turntable 8 which is rotated by a motor (not shown) and a polishing member or polishing pad 10 with the polishing surface 2*a* provided on the top surface of the turntable. The carrier assembly 4 includes a rotatable wafer carrier 12 for holding the wafer 6 in contact with the polishing surface 2*a* of the polishing member 10, and a rotational shaft 14 to which the wafer carrier 12 is securely connected.

The carrier assembly 4 is supported by a support assembly 15. The support assembly 15 includes a stationary vertical column 18, a swingable arm 20 which is pivotally mounted on the column 18 for pivotal movement around the axis of the column 18 and rotatably supports the shaft 14 in such a manner that the shaft 14 can move along its axis. A motor 17 mounted on the top end of the column 18 for rotatably driving the rotational shaft 14 through a transmission means (not shown) provided in the arm 20 and a lift 16 for raising and lowering the rotational shaft 14 with the wafer carrier 12. The lift 16 includes an air piston-cylinder unit 16*a*, the piston of which is connected to the arm 20 and a support arm 16*b* (FIG. 3) which extends horizontally from the cylinder 16*a* and rotatably supports the rotational shaft 14 in such a manner that the rotational shaft 14 is raised and lowered accompanying the up and down movement of the support arm 16*b* (FIG. 3) and the cylinder 16*a*. The position of the wafer carrier 12 relative to the turntable 8 is adjusted by the lift 16. The support assembly 15 further includes a motor (not shown) for pivoting the arm 20 around the axis of the column 18, whereby the wafer carrier 12 is pivoted around the axis of the column 18 to replace a polished wafer 6 with a new one.

The wafer carrier 12 is provided with a vibration detector 21, such as a piezoelectric element for detection of the vibration caused by the rubbing of the wafer 6 against the polishing member 10. Also provided on the wafer carrier 12 is a light signal emission device 22 including an amplifier 22*a* (FIG. 2) to amplify the electrical signals generated by the detector 21 in response to the vibration detected by the detector 21. The light signal emission device 22 generates light signals on the basis of electrical signals from the vibration detector 21, and further includes a filter circuit 22*b* (FIG. 2) for allowing electrical signals representing vibrations within a predetermined range of frequencies to pass and an infrared light emission device 22*c*. The infrared light emission device 22 is connected to an optical fiber 23*a* which passes through the center of the rotational shaft 14 up to the top surface of the shaft. Above the top end of the optical fiber 23*a* is a light signal receiving device or photo sensor 25 which is spaced away from the top end of the optical fiber 23*a* and is securely mounted on a stationary part 34 of the polisher. The light signal receiving device 25 is adapted to receive light signals delivered from the infrared light emission device 22*c* and emitted from the top end of the optical fiber 23*a* and to transform the received signals into electrical signals. The electrical signals are, in turn, transmitted to a signal processing circuit 27 by way of the transmission line 26.

Figure 2:
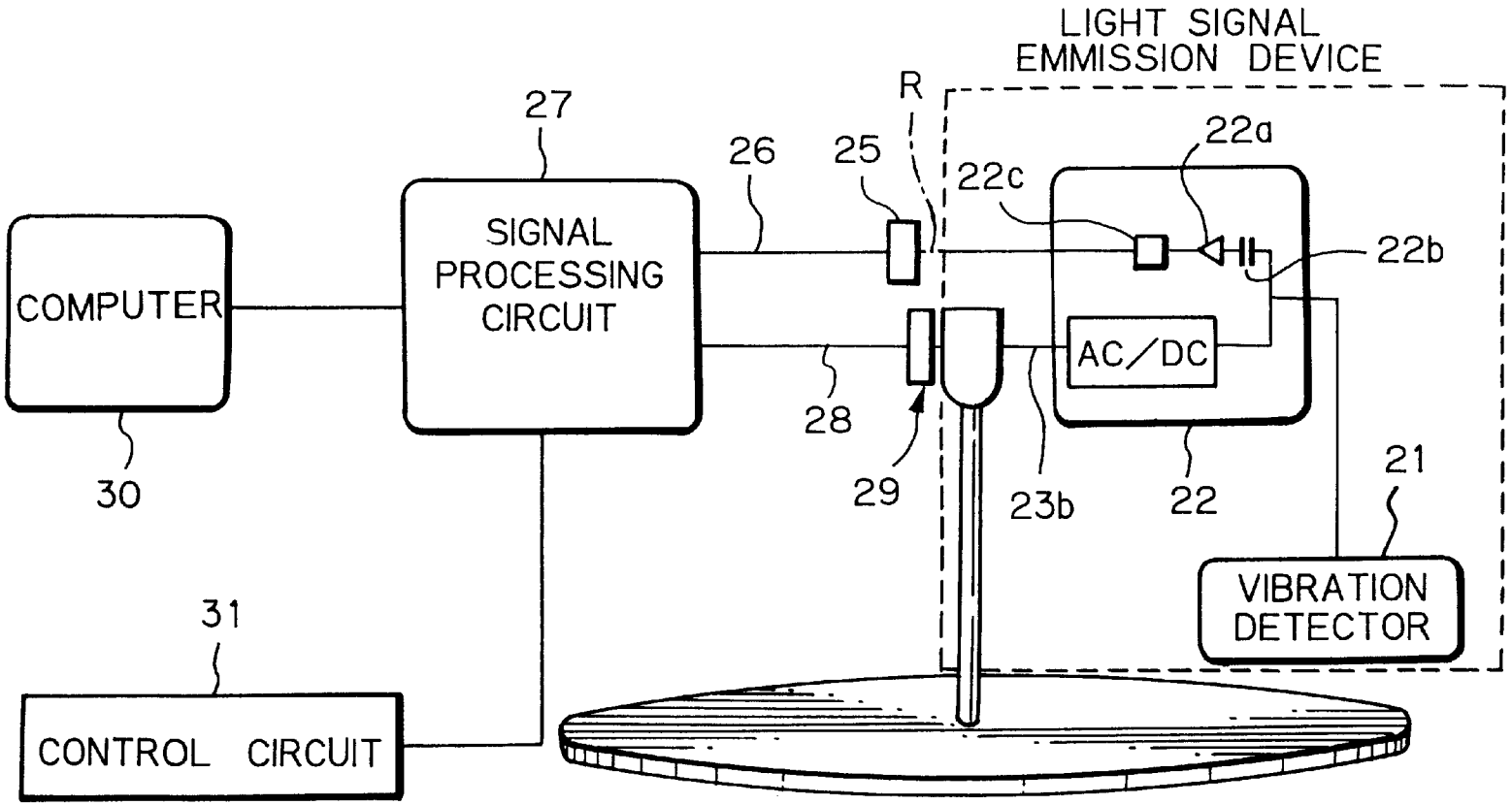
FIG. 2 is a diagram showing the vibration detection system of the first embodiment.

The signal processing circuit 27 is, as shown in FIG. 2, connected to a computer 30 and to a control circuit 31 for controlling a drive (not shown) of the polisher. The signal processing circuit 27 analyses the signals received from the light signal receiving device 25 and delivers resultant signals to the computer 30 which includes a control panel (not shown). When the computer 30 receives resultant signals indicating that an expected change in the vibration detected by the vibration detector 21 has occurred, the computer 30 delivers a command to the control circuit 31 by way of the signal processing circuit 27 to halt the polishing operation. Simultaneously, the control circuit 31 energizes the drive to operate the lift 16 for replacement of the polished wafer with a new one. The resultant signals received by the computer 30 can also be used by an operator to, for instance, manually operate the drive.

With reference to FIGS. 1 and 2, a power supply means is shown which supplies electric power to the light signal emission device 22. The power supply means includes a rotary transformer 29 provided at the top end of the rotational shaft 14 and a power line 28 extending from the signal processing circuit 27 to the rotary transformer 29. The transformer 29 includes an inner rotary coil 30*a* secured on the top end of the rotational shaft 14 and an outer coil 30*b* coaxial with the inner coil 30*a* and provided on a stationary part of the polisher (not shown). The outer coil 30*b* receives an alternating current from the power line 28, whereby another alternating current is induced in the inner coil 30*a*. The inner coil 30*a* is connected to a AC/DC converter (FIG. 2) to convert the induced alternating current into a direct current to supply the direct current to the light signal emission device 22. Since the above-noted power supply means transmits electric energy from the stationary side of the polisher to the rotational side of the polisher without an electrical connector consisting of a stationary contact element and a rotational contact element rotatably engaged with the stationary element, as conventionally used in prior art polishers, the noise generated in such prior art polishers can be avoided.

In operation, when a certain amount of dielectric layer of a semiconductor wafer is removed and a circuit which underlies the dielectric layer is exposed, the surface condition of the wafer will substantially change. Such a change gives rise to a substantial change in the vibration characteristics caused by the rubbing of the wafer against the polishing pad. Such a change in the vibration is detected by the vibration detector 21 and the light signal emission device 22 generates an infrared signal representing the change. The infrared signal is transmitted through the optical fiber 23*a* and emitted from the top end of the optical fiber 23*a*. The emitted light signal is received by the light signal receiving device 25 which converts the light signal into an electrical signal which is transmitted to the signal processing circuit 27, whereby the polisher drive is deenergized to halt the polishing operation. In accordance with this embodiment, since the signal indicating a change in the vibration detected by the detector 21 provided on the rotational carrier assembly is transmitted to the signal processing circuit 27 provided on a stationary part of the polisher without an electrical connector consisting of a stationary contact element and a rotational contact element rotatably engaged with the stationary element as conventionally used in the prior art polishers, the noise generated in such prior art polishers can be avoided.

Figure 3:
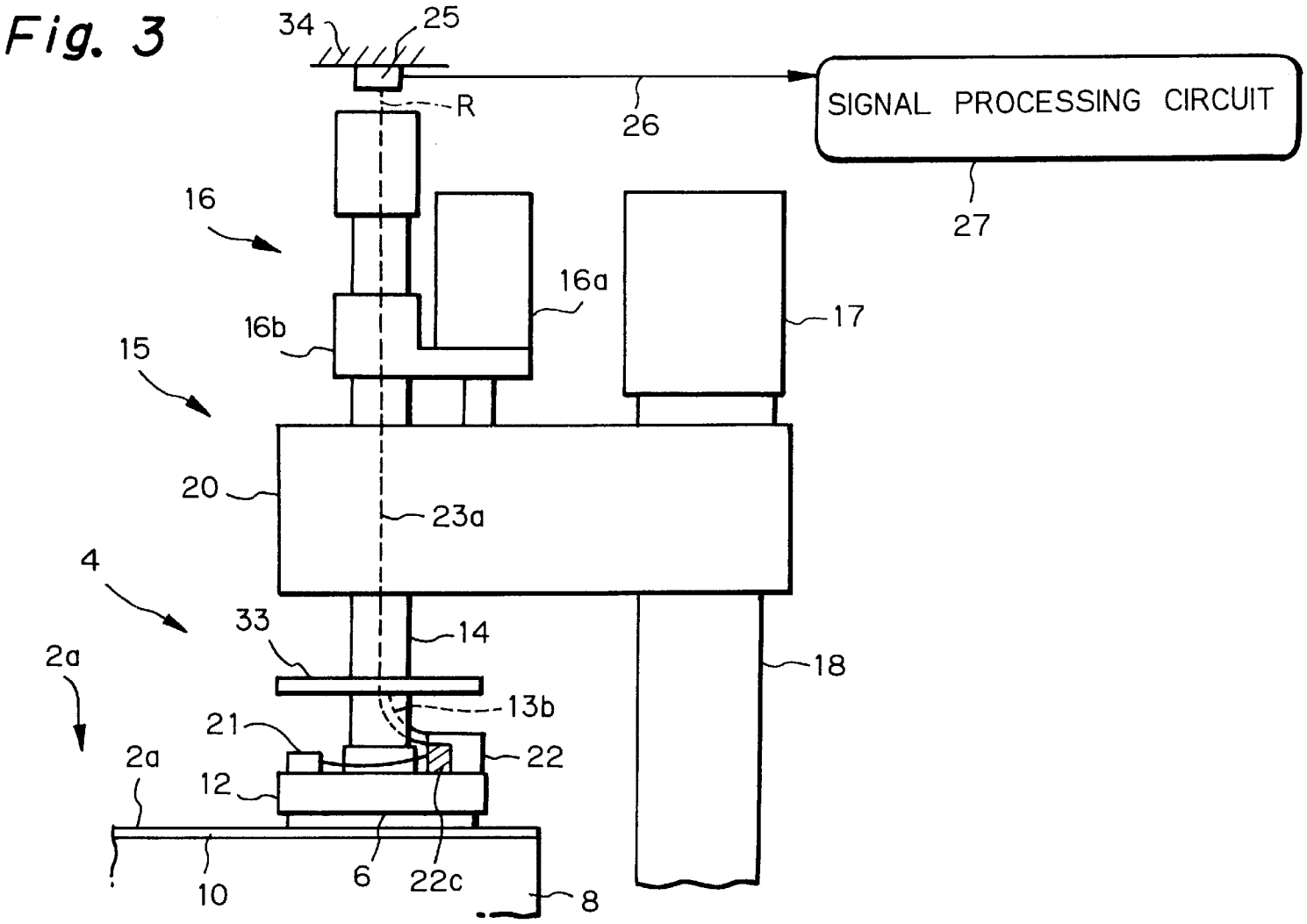
FIG. 3 is a schematic side elevation view of the main part of a semiconductor wafer polisher in accordance with a second embodiment of the present invention.
Figure 4:
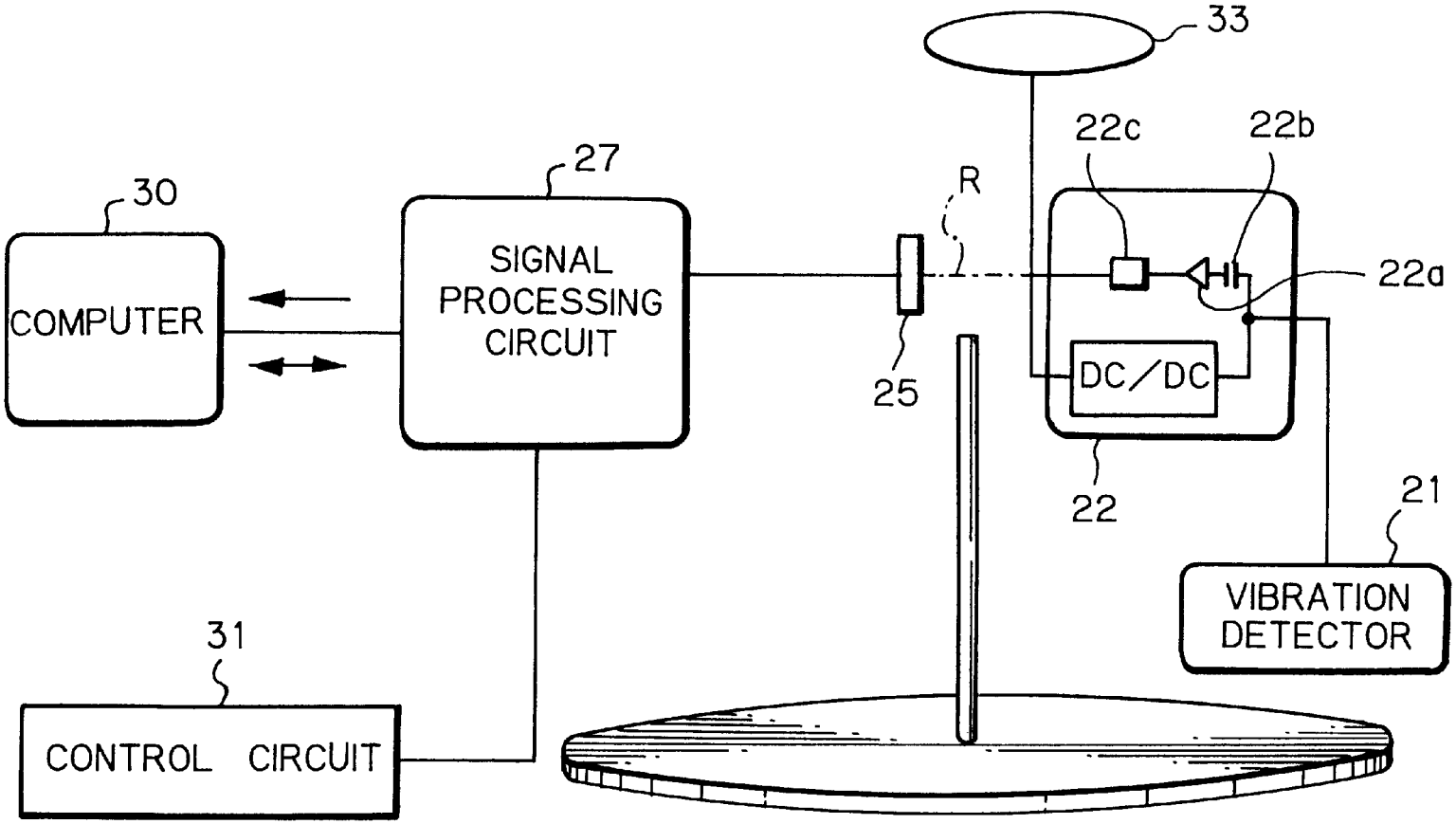
FIG. 4 is a diagram showing the vibration detection system of the second embodiment.

The semiconductor wafer polisher in accordance with the second embodiment, as shown in FIGS. 3 and 4, generally has the same construction as the first embodiment and, thus, the elements which all equivalent to those of the first embodiment are assigned the same reference numbers in the second embodiment. However, this polisher differs from that of the first embodiment in that a solar cell panel 33 is provided on the rotational shaft 14 as a power supply means in place of the power supply means employed in the first embodiment. The solar cell panel 33 is capable of generating electric power from a light directed at the turntable 8 during operation, the generated power being sufficient to energize the light signal emission device 22 associated with the vibration detector 21. For the sake of simplicity, the description of the elements other than the solar cell panel 33 and the functions thereof is omitted.

It will be appreciated that, although specified embodiments of the invention have been described herein for the purpose of illustration, various modifications may be made without departing from the spirit and scope of the invention. Accordingly, the invention is not limited except as stated in the appended claims.

What is claimed is:

1. A polisher comprising:

a turntable assembly including a turntable with a polishing surface, said turntable assembly being rotated around a turntable axis passing through the center of and substantially normal to said polishing surface:

a rotatable carrier assembly which is rotatable around a carrier axis substantially parallel to said turntable axis of said turntable assembly and including a carrier for holding an article in contact with said polishing surface to polish the article;

a vibration detection unit provided on one of said turntable assembly and said rotatable carrier assembly, said vibration detection unit including a vibration detector for detecting a vibration caused by rubbing of the article against said polishing surface and a light signal emission device for emitting a light signal representing the vibration detected by said vibration detector;

a light signal processing assembly provided on a stationary part of the polisher and including a light signal receiving device for receiving said light signal emitted from said light signal emission device.

2. A polisher as set forth in claim 1, in which said rotatable carrier assembly further comprises a rotational shaft connected to said carrier in such a manner that said carrier is rotated around a shaft axis of said rotational shaft, said vibration detector and said light signal emission device are provided on said carrier, said vibration detection unit further includes an optical fiber connected to said light signal emission device and extending through a center of said rotational shaft towards a distal end of said rotational shaft, and said light signal receiving device is positioned opposite said distal end of said rotational shaft to receive said light signal transmitted through said optical fiber and emitted from a distal end of said optical fiber.

3. A polisher as set forth in claim 2, further comprising an inner coil provided on said rotational shaft of said rotatable carrier assembly and electrically connected to said vibration detection unit and an outer coil provided on a stationary part of the polisher which is coaxial with said inner coil, said inner and outer coils forming a rotary transformer which transmits electrical energy applied to said outer coil to said inner coil by magnetic induction to energize said vibration detection unit.

4. A polisher as set fourth in claim 1, further comprising a solar cell panel provided on said rotatable carrier assembly and electrically connected to said vibration detection unit so that said solar cell panel supplies electrical energy to energize said vibration detection unit.

5. A polisher as set forth in claim 1 wherein said rotatable carrier assembly further comprises a rotational shaft connected to said carrier in such a manner that said carrier is rotated around a shaft axis of said rotational shaft, said vibration detector and said light signal emission device are provided on said carrier, said vibration detection unit further includes an optical fiber connected to said light signal emission device and extending through a center of said rotational shaft towards a distal end of said rotational shaft, said light signal receiving device is positioned opposite said distal end of said rotational shaft to receive said light signal transmitted through said optical fiber and emitted from a distal end of said optical fiber, and the polisher further includes a solar cell panel provided around said rotational shaft of said rotatable carrier assembly, said solar cell panel being electrically connected to said vibration detection unit so that said solar cell panel supplies electrical energy to energize said vibration detection unit.

6. A polisher as set forth in claim 1, wherein said light signal emission device generates signals of infrared light.

7. A polisher including:

a polishing assembly including a polishing member with a polishing surface;

a carrier assembly including a carrier for holding an article in contact with said polishing surface, said carrier assembly and said polishing assembly being moved relative to each other to polish said article;

a detection assembly provided on one of said polishing assembly and said carrier assembly, said detection assembly including a detector for detecting a change in a polishing condition arising during a polishing and a light signal emission device for emitting a light signal representing the change in the polishing condition detected by said detector; and a light signal processing assembly provided on a stationary part of the polisher and including a light signal receiving device for receiving said light signal emitted from said light signal emission device.

* * * * *